US007025068B2

(12) United States Patent
Dumler

(10) Patent No.: US 7,025,068 B2
(45) Date of Patent: Apr. 11, 2006

(54) APPLICATOR, IN PARTICULAR MASCARA BRUSH

(75) Inventor: Norbert Dumler, Ansbach (DE)

(73) Assignee: Geka Brush GmbH, Bechhofen (DE)

( * ) Notice: Subject to any disclaimer, the term of this patent is extended or adjusted under 35 U.S.C. 154(b) by 169 days.

(21) Appl. No.: 10/601,878

(22) Filed: Jun. 24, 2003

(65) Prior Publication Data

US 2004/0261811 A1 Dec. 30, 2004

(51) Int. Cl.
*A45D 40/26* (2006.01)
*A46B 9/007* (2006.01)

(52) U.S. Cl. ..... 132/218; 15/206

(58) Field of Classification Search ..... 132/218, 132/313, 320; 15/167.1, 206, 168; 401/129
See application file for complete search history.

(56) References Cited

U.S. PATENT DOCUMENTS

| | | | | |
|---|---|---|---|---|
| 3,939,520 | A * | 2/1976 | Axelsson | 15/167.1 |
| 3,998,235 | A | 12/1976 | Kingsford | |
| 4,498,490 | A | 2/1985 | Seidler | |
| 4,733,425 | A * | 3/1988 | Hartel et al. | 15/206 |
| 5,615,439 | A * | 4/1997 | Bourrelly | 15/104.2 |
| 6,295,994 | B1 | 10/2001 | Thayer | |
| 6,470,897 | B1 * | 10/2002 | Jung et al. | 132/218 |

* cited by examiner

*Primary Examiner*—John J. Wilson
*Assistant Examiner*—Robyn Doan
(74) *Attorney, Agent, or Firm*—Browdy and Neimark, PLLC

(57) ABSTRACT

In an applicator, in particular a mascara brush, comprising a plurality of bristles which are held between two intertwisted wire sections, with the bristles passing through a helical reinforcing element, it is provided that the reinforcing element is a two-flight helix.

5 Claims, 2 Drawing Sheets

APPLICATOR, IN PARTICULAR MASCARA BRUSH

BACKGROUND OF THE INVENTION

1. Field of the Invention

The invention relates to an applicator, in particular a mascara brush, comprising a plurality of bristles which are held between two intertwisted wire sections, with the bristles passing through a helical reinforcing element.

2. Background Art

Applicators of the generic type are used for lots of purposes. A major field is the application of liquid mascara on the lashes or of hair dyes on the hair.

In mascara brushes of the generic type, it is especially important that, when dipped into the liquid mascara, they have sufficient transfer capacity for a certain quantity of liquid mascara to be taken from the reservoir and applied to the lashes, it being desirable that this application be uniform, without lumping, and that the lashes be combed and separated during application.

For the applicators to be adapted to a certain composition and viscosity of the liquid mascara or for certain make-up effects to be obtained, there are numerous familiar modifications in the selection and composition of the bristles. In particular, it has been disclosed to mix soft and hard bristles and/or to compose a trimming of short and long bristles so that part of the bristles may take on functions of application and another part predominantly functions of combing. However, the possibilities of modification are restricted in these conventional applicators, conditioned by manufacturing requirements.

U.S. Pat. No. 6,295,994 B1 teaches to surround the bristles by a reinforcing element of plastic material or wire of helical configuration, the diameter of which is less than the diameter of the trimming so that the bristles of the trimming may extend between the individual threads and rotate, but are nevertheless guided and separated.

A reinforcing element of this type reinforces a conventionally twisted applicator in such a way that even very few or especially fine and soft fibers can be used for application which, without the reinforcing element, would not be able to fulfil the desired properties of application and combing. This design further ensures the use of very few and/or thin fibers, accompanied with an increase in diameter of the wire core of the applicator by wire of greater diameter being used for the core; this helps efficiently counter any undesirable build-up of mascara around the wire core of the applicator, the individual windings of bristles, which are now further apart, being stabilized by the flexible spring element between two neighboring helical lines. This reduces any build-up of lumping and smearing mascara compound around the wire core as well as the deposit of unused mascara.

An applicator of this type can be suited to a specific purpose much better than conventional constructions, it being possible, in addition to parameters that involve the properties of intertwisted wire and bristles, also to vary the diameter and strength of the spring element.

Mascara brushes with comparable reinforcing elements are described in U.S. Pat. No. 3,998,235 and U.S. Pat. No. 4,498,490.

A substantial drawback of familiar reinforcing elements, such as described in U.S. Pat. No. 6,295,994 B1 of the species, resides in that the ends of the reinforcing element are open so that the ends of the wire, which are cut off, constitute a considerable risk of injury to a user's eyes in the process of putting makeup on.

SUMMARY OF THE INVENTION

It is an object of the invention to embody an applicator and a reinforcing element of the type mentioned at the outset in such a way that producibility at a low cost is ensured, while any risk of injury of a user is avoided without the makeup effect and application being impaired.

According to the invention, this object is attained by the reinforcing element being a two-flight helix.

This means there is no free open end of a first helical flight as in conventional products; rather, a second helical flight proceeds from the free end and leads back so that a rounded transition is produced at the end, precluding any risk of injury.

In addition to the aspect of safety, a two-flight construction offers possibilities of variable design.

In keeping with a special design, provision may be made for the threads of the individual flights to be asymmetric such that the pitch of a first section of thread is greater than it is in a second section, the free interstice for the bristles to pass through alternately having a smaller distance B and a greater distance C.

Provision may further be made for the free ends of the wire to be disposed in a special annular gap and/or in the recess that houses the stem. This helps attain that the free ends of the wire, which may have sharp edges, do not stand out, which also further reduces any risk of injury.

Details of the invention will become apparent from the ensuing description of a preferred embodiment, taken in conjunction with the drawing.

DESCRIPTION OF A PREFERRED EMBODIMENT

Figure 1:
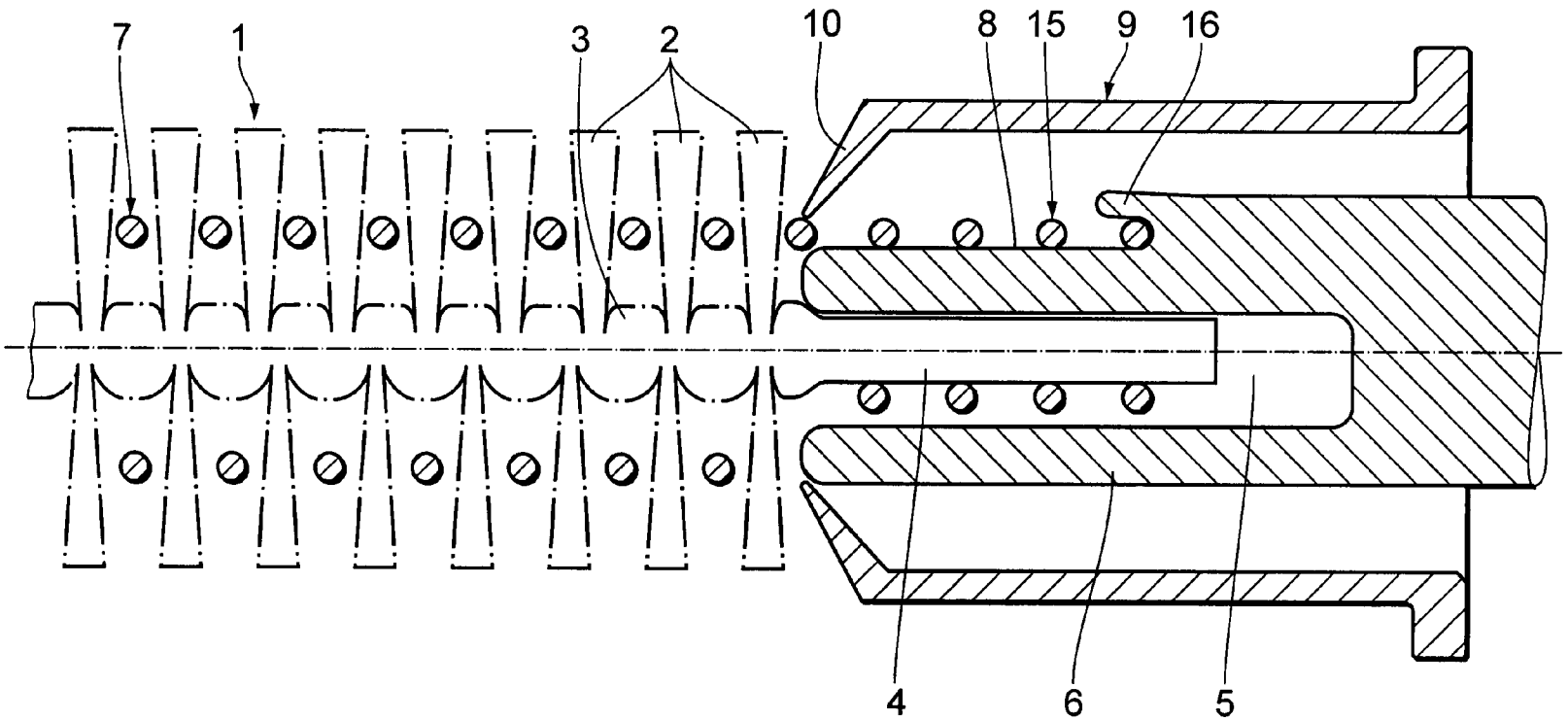
FIG. 1 is an illustration of the outer end of a mascara applicator with a helical reinforcing element.

As seen in the drawing, an applicator 1 in the form of a mascara brush comprises a plurality of bristles 2 or, respectively, of tufts of bristles, which are fixed in a wire core 3 formed by two intertwisted wires.

A free end 4 of the wire core 3 which is not trimmed with bristles is fixed in a recess 5 of a stem 6.

A reinforcing element 7 is provided in the form of a helical spring. In the embodiment seen in FIG. 1 top, provision is made for a helical spring of metal with a wire of round cross-sectional shape, whereas the embodiment at the bottom of FIG. 1 uses a helical spring of plastic material of approximately rectangular cross-sectional shape. In this embodiment, the diameter of the "wires" is greater and the density of trimming is lower.

The reinforcing element 7 has a diameter which is approximately half the diameter of the trimming of the brush 1; it is slipped on the applicator 1 after the applicator 1 has been manufactured conventionally. Preferably, this takes place by frictional engagement with a tapered section 8 of the stem 6.

The liquid mascara reservoir—not seen in FIG. 1—is provided with a wiper 9 with flexible lips 10, the diameter of the free passage between the wiping lips 10 being slightly smaller than the diameter of the reinforcing element 7.

Figure 2:
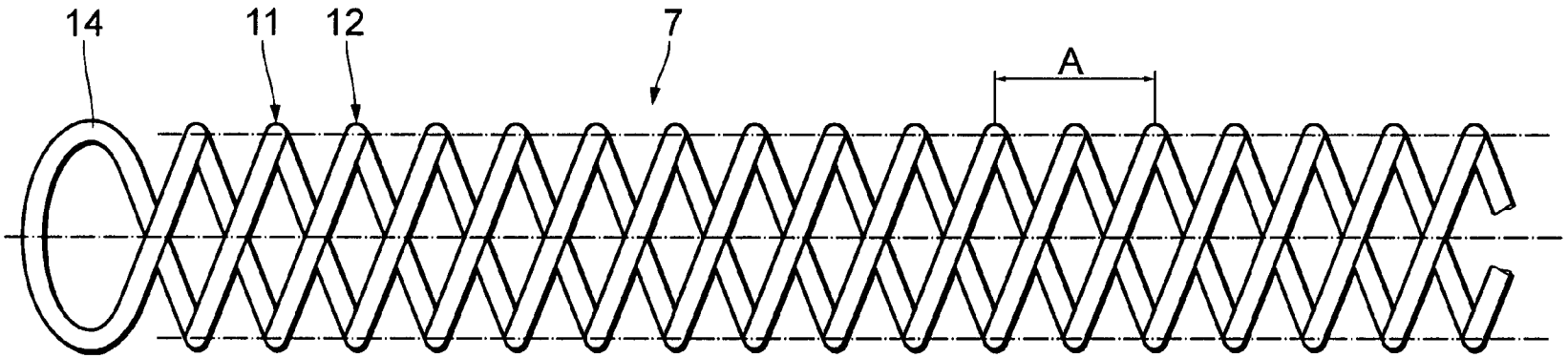
FIG. 2 is a perspective plan view of a reinforcing element according to the invention.

FIG. 2 illustrates a reinforcing element 7 according to the invention in the form of a helical wire structure which has two flights 11 and 12, each individual flight 11 and 12 again having a helical configuration. In the vicinity of the free outer end of the reinforcing element 7, the two flights 11, 12 are united by a rounded section 14, there being no free ends and any risk of injury being precluded.

Figure 3:
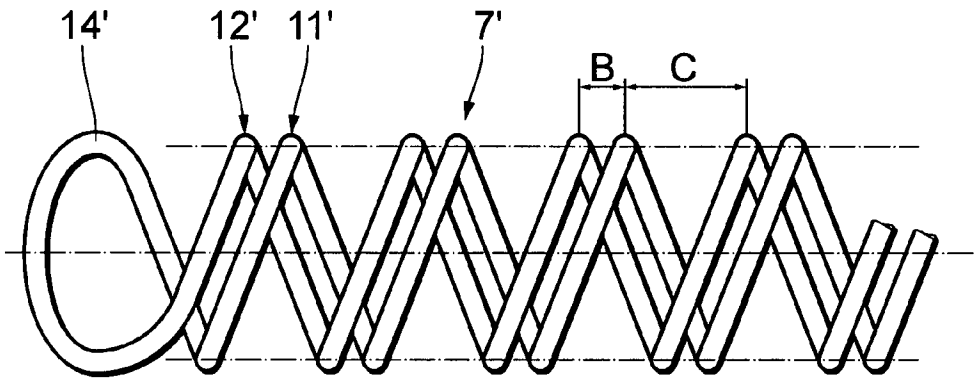
FIG. 3 is a perspective view of another embodiment of the reinforcing element according to the invention.

In the embodiment according to FIG. 2, both flights 11, 12 have a constant lead A over the entire length. In the embodiment, seen in FIG. 3, of a reinforcing element 7', the individual threads of the flights 11' and 12' are intrinsically asymmetric i.e., the first part of a thread has a greater pitch than the second part, so that the free interstice for the bristles 2 to pass through alternately has a smaller distance B and a greater distance C.

FIG. 1 shows two possibilities of accommodating the free ends 15 of the reinforcing element 7. They may be disposed either in an annular gap 16 on the stem 6 (see FIG. 1 top) or in the recess 5 which houses the end of the intertwisted wires of the original brush and the free ends of the two-flight helix (see FIG. 1 bottom).

What is claimed is:

1. An applicator (1) for use as a mascara brush, comprising: a stem; and a plurality of bristles (2) which are held between two intertwisted wire sections, with the bristles (2) passing through a helical reinforcing element (7), wherein the reinforcing element (7) is formed by two individual flights of helix each of the flights having a first end engaged to each other at a first end of the reinforcing element and a free second end at the second end of the reinforcing element, and further wherein said second end of the reinforcing element is connected to said stem.

2. The applicator (1) according to claim 1, wherein threads of the two individual flights are asymmetrical such that a pitch of a first section of the thread is greater than that of a second section, with a free interstice for the bristles (2) to pass through alternatively having a smaller distance B and a greater distance C.

3. The applicator (1) according to claim 1, wherein the free second ends (15) of the two individual flights of helix are arranged in either a specific annular gap (16) or a recess (5) which accommodates free ends of intertwisted wires of the original brush and the free second ends (15) of the two individual flights.

4. The applicator (1) according to claim 1, wherein the first ends of the two individual flights of helix are engaged together by a rounded portion.

5. The applicator (1) according to claim 4, wherein the two individual flights of helix and the rounded portion are formed as a unit.

* * * * *